US005162967A

United States Patent [19]

Ojanguren Torrontegui

[11] Patent Number: 5,162,967

[45] Date of Patent: Nov. 10, 1992

[54] AUTOMATIC SECTIONALIZER

[75] Inventor: Javier Ojanguren Torrontegui, Munguia, Spain

[73] Assignee: Mesa Gatica, S.A., Vizcaya, Spain

[21] Appl. No.: 624,349

[22] Filed: Dec. 7, 1990

[30] Foreign Application Priority Data

Dec. 28, 1989 [ES] Spain ..... 8904403

[51] Int. Cl.[5] ..... H01H 73/10

[52] U.S. Cl. ..... 361/115; 335/27; 337/171

[58] Field of Search ..... 361/132, 131, 133, 115, 361/117, 139, 143; 335/27, 32, 26; 337/168, 169, 171, 172, 173, 174

[56] References Cited

U.S. PATENT DOCUMENTS 3,321,721 5/1967 Smith, Jr. ..... 335/26
3,365,956 1/1968 Koch ..... 335/26
4,768,010 8/1988 Brown et al. ..... 337/169
4,795,996 1/1989 Brown et al. ..... 337/169
4,935,715 1/1990 Popeck ..... 337/169

*Primary Examiner*—A. D. Pellinen
*Assistant Examiner*—C. Schultz
*Attorney, Agent, or Firm*—Darby & Darby

[57] ABSTRACT

The sectionalizer comprises a means that automatically sections a circuit under preset conditions, for the purpose of insulating and signaling the line defect, when said sectionalizer is mounted between some contacts fixed to an insulating support.

The sectionalizer consists of a conductor tube which, independently of other elements, includes an electromagnetic triggering mechanism or device formed by an electromagnet functionally associated to a mechanical multiplier which is comprised by two arms that, in the inoperative position of the electromagnet, sustains a triggering rod maintaining the contact of the sectionalizer, while the activation of the electromagnet entails liberation by the arms of the multiplier, of the triggering rod, producing the opening of the circuit.

1 Claim, 4 Drawing Sheets

AUTOMATIC SECTIONALIZER

OBJECT OF THE INVENTION

As is expressed in the title of this specification, the present invention refers to an automatic sectionalizer, provided with a series of features and novel aspects with regard to those presently known, providing some new services.

The sectionalizer is provided so that a triggering mechanism with which the same is furnished, fed by the discharge of a condenser and when the line is voltageless, produces the opening, insulation and signaling of the phase or phases through which a current higher than the preset one is passing, not needing to exchange any accessory, it sufficing to manually reset the device for a new start of the sectionalizer.

BACKGROUND OF THE INVENTION

Sectionalizers that are based on a similar mounting, operation and line defect detection technique are known and which have the inconvenience of once the opening is produced by operation, according to the present program, it is necessary to replace the triggering device for a new commissioning.

These sectionalizers that are mounted between contacts foreseen on an insulating support have a contact system and some dimensions which are the ones that commonly correspond to XS type expulsion circuit breakers of the firm S § C ELECTRIC COMPANY.

These sectionalizers are maneuvered with a rod and have the particular feature that they are interchangeable with fuseholders of the XS type circuit breakers of the above cited firm, without the need of using adapting accessories.

In short, it can be said that the presently known sectionalizers require that some of its elements be replaced for the new commissioning thereof, once the opening of the conductor tube has been effected by operation according to the preset program and this is due to the fact that some of these blow out and therefore the corresponding replacement is necessary.

DESCRIPTION OF THE INVENTION

The sectionalizers object of the invention are mounted between contacts provided on an insulating support and are based on a conductor tube with toric transformers for capturing overintensity that passes through said tube. The transformers are located on the outside of said conductor tube, but duly encapsulated to endure service thereof outdoors. The signals obtained in these toric transformers are duly treated with the logic necessary to open the sectionalizer when the preset conditions are complied with.

For the purpose of avoiding the problem implied by replacing any element in the new commissioning of the selector itself, some improvements based on the arrangement of an electromagnetic device have been foreseen, including an electromagnet and a mechanical multiplier, in such a way that when said electromagnet is excited the mechanical multiplier frees a triggering rod producing the corresponding opening of the sectionalizer that insulates and signals the corresponding defect, all of that when under some predetermined conditions the passing of a current higher than the preset one is produced.

The sectionalizer according to these innovations or novel aspects is maneuvered by a rod for the mounting, opening, closing and dismounting of the same.

In short, it can be said that the novel aspect that the sectionalizer incorporates is such that the resetting so that it can operate again is done without having to replace any element.

As to the electromagnet on the basis of which activation of the mechanical multiplier of the same is achieved, it is excited by discharge of a condenser, in such a way that said discharge will be produced in the moment and under the conditions that have been preset beforehand in electronic logical equipment, in charge of controlling, charging and discharging the cited condenser.

The core of the electromagnet in the reset position remains placed between the ends of both arms connected together by means of a tension spring, arms which remain vertically arranged and that in that inoperative position or reset position make the opposite ends slightly elbowed, remain close to each other and retain a rod displaceable axially along the conductor tube constituting the sectionalizer and whose rod emerges outside to connect to a triggering pawl.

When the excitation of the electromagnet is produced as said above, its core withdraws and then the arms remain separated at the top, by the action of the spring, they join, separating however the bottom ends and therefore freeing the axial rod, moving towards the outside and freeing the triggering pawl, which gives rise to the drop of the conductor tube, separating from the top contact foreseen for that purpose in the insulating support, with the particular feature that being articulated at its bottom end the conductor tube, the latter folds and falls, cutting off the electric circuit, and with the rod the disassembly, resetting and reassembly of the same can take place.

In order to complement the description that is going to be made hereinafter and for the purpose of providing a better understanding of the features of the invention, the present specification is accompanied by a set of drawings on the grounds of which one will understand more easily these innovations and novel aspects of the invention.

DESCRIPTION OF A PREFERRED EMBODIMENT

Figure 1:
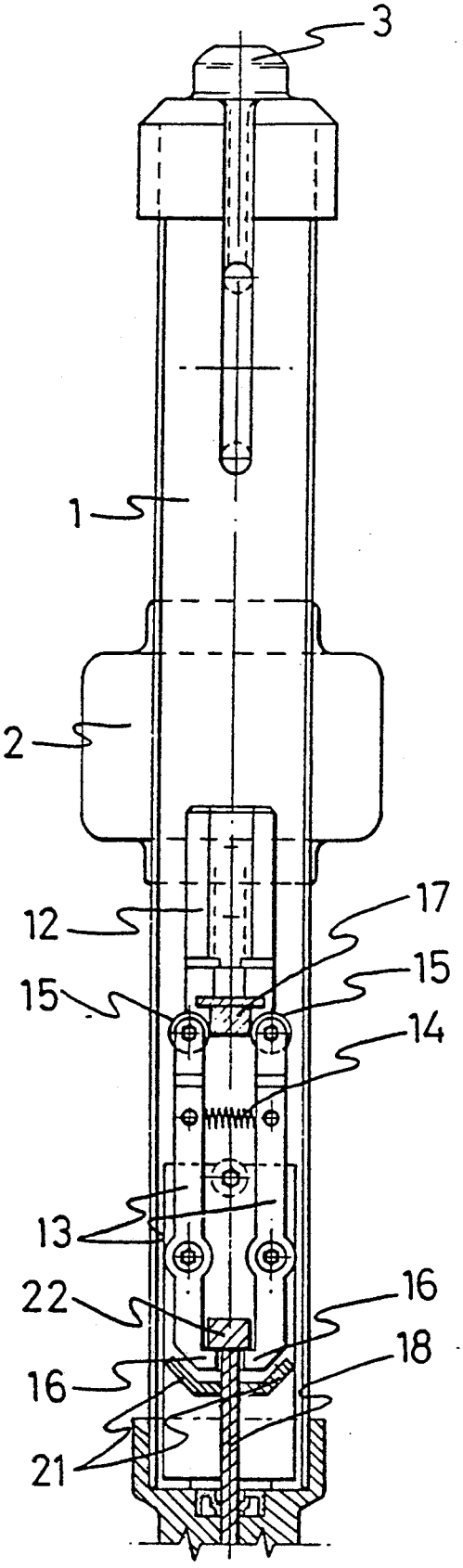
FIG. 1—It shows a longitudinal view of the conductor tube constituting the sectionalizer object of the invention, with its bottom half sectioned making it possible to see the triggering device formed by the electromagnet and the mechanical multiplier constituted by the association of the two arms that support and hold the displaceable rod, all in usage position or reset position.

In view of these figures, once can see how the automatic sectionalizer of the invention is comprised of a conductor tube 1 in whose duly encapsulated outer part there are some toric transformers (2) that detect the passing of the sectioning current which as usual will be the same as that which is circulating through the line on which the conductor tube 1 or sectionalizer itself is mounted, which incorporates its corresponding top contact 3 and bottom contact 10, the latter being a rotation contact.

The conductor tube 1 is jointed mounted regarding a bottom support 5 connected to an assembly and disassembly ring 6 to which the corresponding contact 7 is fixed supported by the insulating element 8 the latter having in its top end contact 9, all in such a way that the top contact 3 of the conductor 1 in its assembly regarding the insulating tube 8 will rest on the top contact 9 of the latter, while the bottom contact 10 of the tube will be in connection through the articulated device 5 to the bottom contact 7 supported by the insulating element 8.

On the other hand, the selectionizer or conductor tube 1 includes an operating ring 11, aside from the bottom assembly and disassembly ring 6 in order to carry out the closing of the same.

Figure 3:
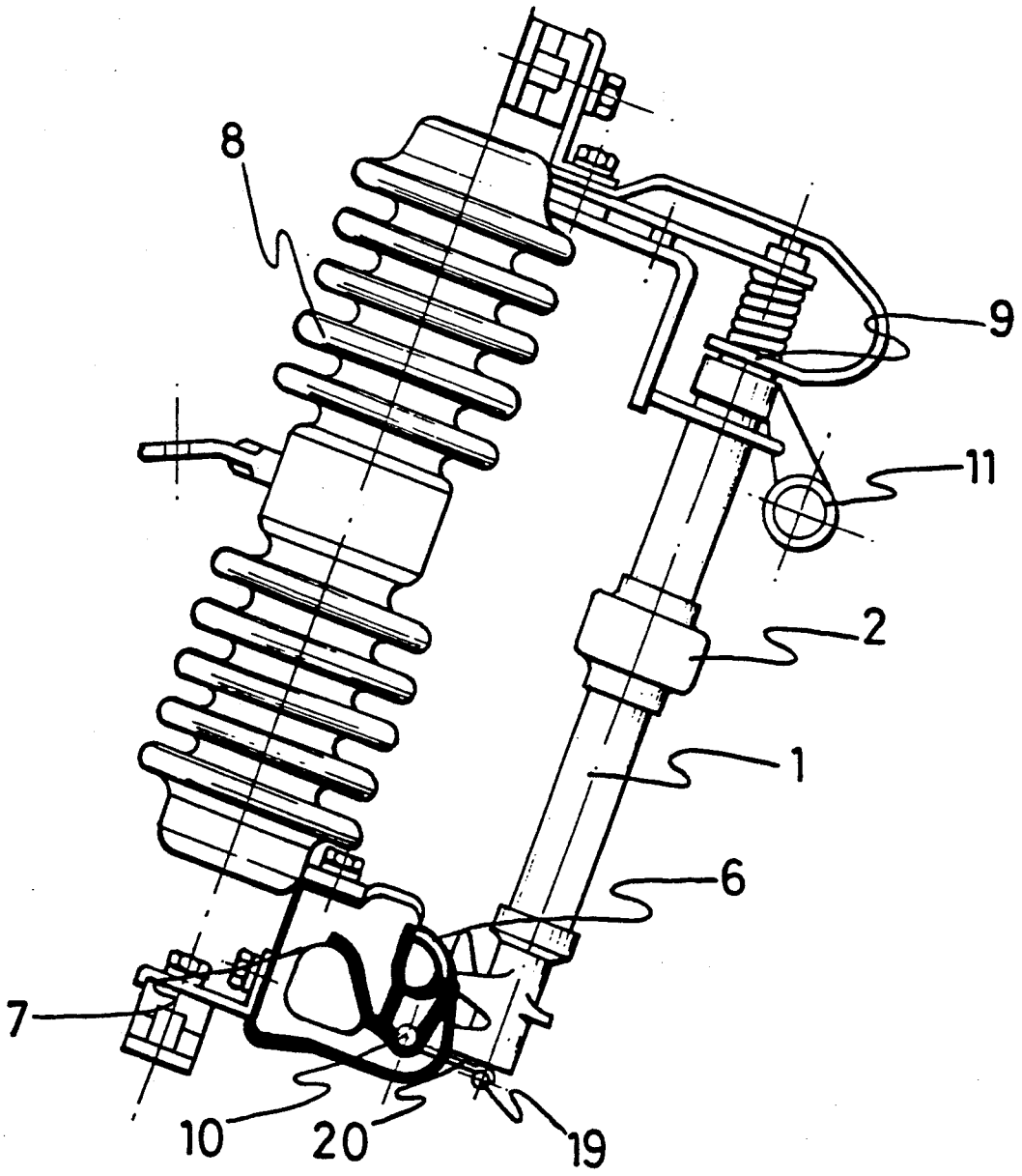
FIG. 3—It shows a side view of the conductor tube mounted in the usage position, in other words, making contact between the respective contacts foreseen in the insulating support.
Figure 4:
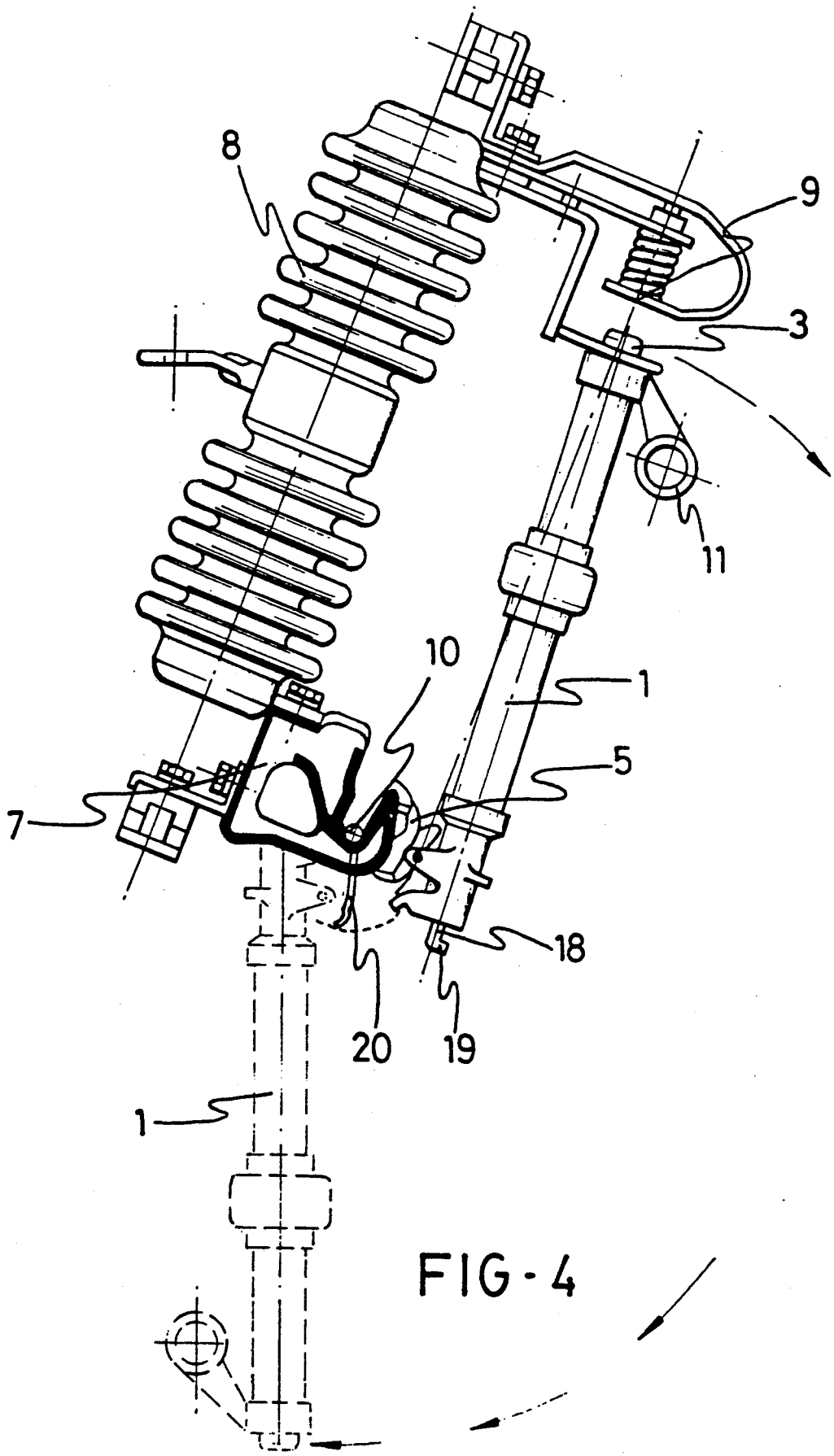
FIG. 4—It shows a view similar to the above one with the conductor tube in the triggering position, showing its separation with regard to the top contact fixed to the insulating support, starting the tilting of the conductor tube to fall and remain suspended as shown in the broken line in this same figure.

As is seen in FIG. 3, the selectionalizer 1 is mounted and in usage position upon the insulating support 8, in such a way that if there is an overintensity or current higher than a previously established one and under preset conditions too, the opening of the sectionalizer 1 is produced by separating its contact 3 regarding contact 9, and tilting at the bottom to fall as is shown in the broken line in FIG. 4 or in other words carrying out the sought opening of the sectionalizer the circuit remaining insulated and the corresponding failure being indicated, all in such away that after producing that opening and remaining in the signaling position, as shown in FIG. 4, the sectionalizer 1 itself is disassembled coupling it to the rod through the assembly ring 6 in order to then proceed to reset and place selectionalizer 1 back in place gathering it with the rod by the ring 6, installing it in the bottom part of the insulating support 8, in such a way that the bottom rotation contact 10 fits in the fixed bottom contact 7 of this insulating support 8, the group remaining ready to effect the closing, which is done placing the rod in the maneuvering ring 11 until it reaches the top contact 3 of sectionalizer 1 locking and contacting with contact 9, which thus put the group into commission.

Figure 5:
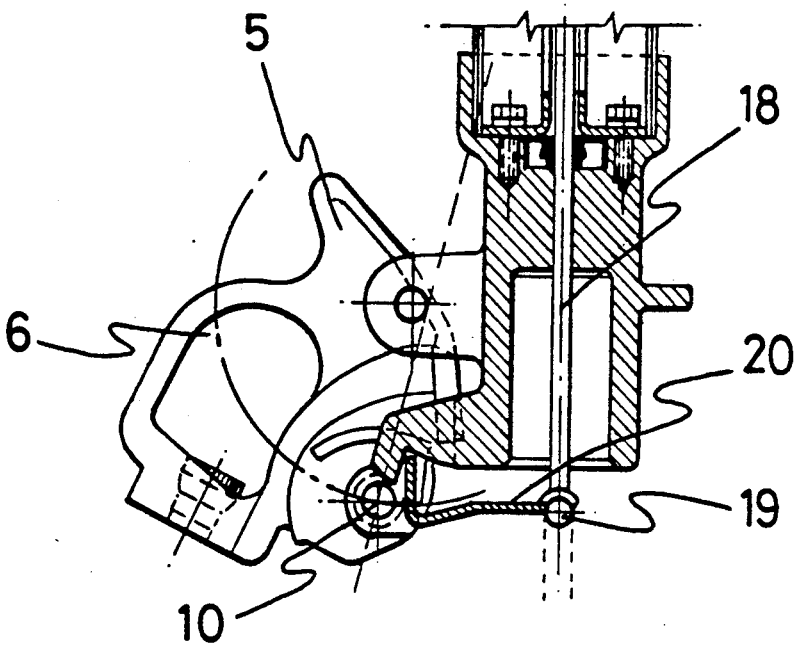
FIGS. 5 and 6—They show both raised views and plan view of the bottom part of the mechanism making it possible to observe the corresponding resetting thereof.
Figure 6:
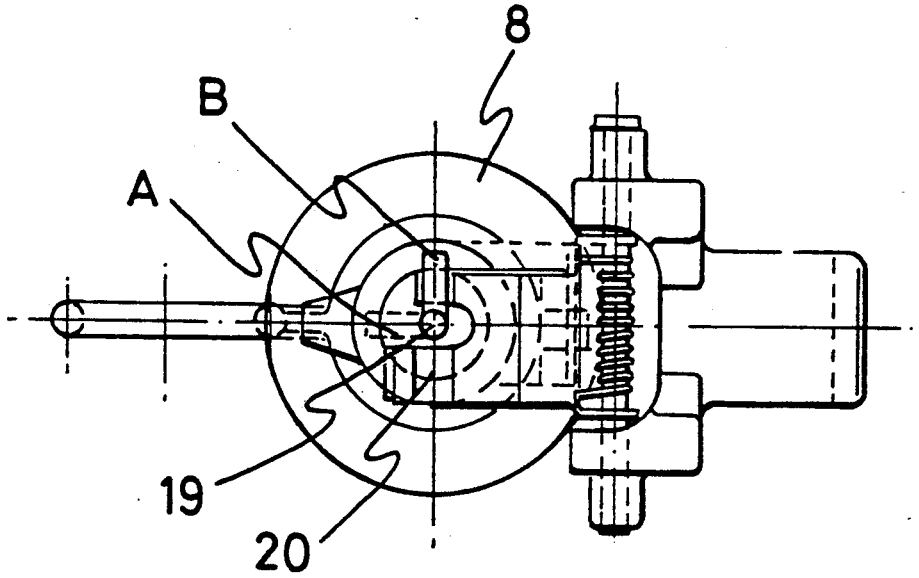

In the described resetting and as is seen in FIGS. 5 and 6 the triggering rod 18 or its elbowed end 19 is pressed so that it remains in position A of charging and subsequently it turns to resetting position B, in such a way that to pass from position A to position B the pawl 20 must be kept pressed.

Upon pressing the rod 18 by its elbowed end 19, the piece or resetter 21 closes at its bottom part the two levers 13, when the moveable locking pawl 22 is inside the fixed pawls 16 and at the same time the top parts open 15 and the core 17 of the coil, in such a way that the device remains reset and ready to operate, just as appears in FIG. 1.

That which has been said up to now can be said to correspond to the general features that arise in this type of sectionalizer, with the exception made that in that which has been described it is observed that the resetting is done without the need of having to replace any part since in conventional sectionalizers the resetting or commissioning entails having to replace some element that burns out in the triggering.

Figure 2:
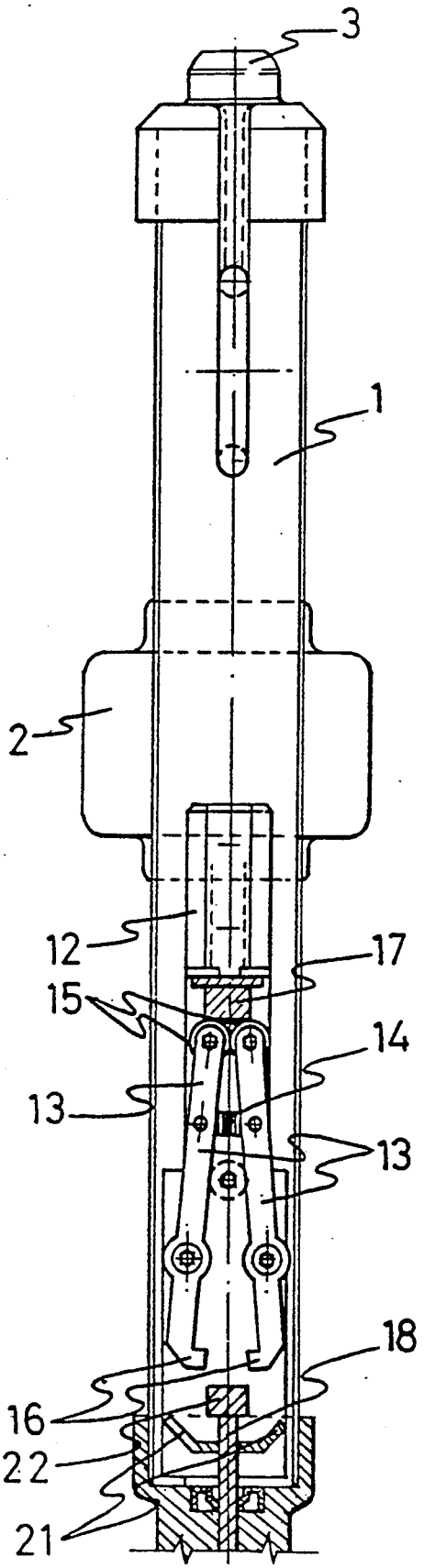
FIG. 2—It shows a similar view of the above view, where the conductor mechanism is in the triggering position.

Now then, this resetting without the need of replacing any elements in the selectionalizer of the invention is carried out by means of including an electromagnetic device which includes an electromagnet 12 in combination with a mechanical multiplier 13, in such a way that the latter is formed by two arms or strips placed parallelly and vertically and pulled by a transversal spring 14 that extend to the top ends 15 of the strips or arms 13. They join as is shown in FIG. 2, while the bottom and slightly elbowed ends facing each other 16 logically tend to separate. The term "mechanical multiplier" is used to denote the action of the arms 13 and accompanying mechanism. The weight of the rod 18 and any forces acting on said rod 18 are many times stronger than the force needed from the electromagnet to keep the arms 13 and rod 18 in place.

Now then, the electromagnet 12 in the inoperative state maintains its core 17 emerging, with which it remains inserted between the ends 15 of the arms of the mechanical multiplier 13, and that top separation of the ends 15 entails that the bottom ends 16 join together, retaining between them a rod 18 that moves axially along the conductor 1 or sectionalizer, until emerging through the bottom part of the same, according to reference 19, elbowing to retain by that bottom end and emerging to the triggering pawl 20.

According to this new concept of the cited mechanism, when preset conditions are produced in the circuit the electromagnet 12 is excited and its core 17 withdraws, freeing the top ends 15 of the mechanical multiplier 13 and by virtue of the spring 14 extend those ends 15 to join as is shown in FIG. 2, with which the ends 16 separate the rod 18 which is found held by the approximation of those ends 16, will logically remain released projecting towards the outside and emerging from the bottom end of the sectionalizer 1, freeing the already commented pawl 20, producing the tilting of the articulation elements, which entail a displacement downward of the selectionalizer itself 1, as is shown in FIG. 4 itself, separating from the top contact 3 with regard to the contact 9 of the support 8 which entails that the selectionalizer 1 tilts downward as has already been said above.

In other words, in the triggering operation there is bottom displacement of the rod 18, release of the pawl 20 and tilting movement of the elements that support at the bottom of the selectionalizer 1 itself, producing the subsequent separation of the top contacts 3 and 9 and producing definitively the opening of the selectionalizer and that without burning out any element, permitting resetting and new commissioning of the unit without the need to replace any element.

In all the sectionalizer 1 or tube that constitutes it is made out of copper and its diameter and section will be the adequate ones so that the rated working current and the short-cut current foreseen will be supported.

As has been said throughout the present description the unit has outer toric transformers 2, that are used to charge the corresponding condenser with adequate capacity and voltage, in order to produce the execitation of the electromagnet 12. Likewise, these transformers are used to feed the corresponding electronic logical circuit which, when the preset conditions are complied with, produces the discharge of the condenser referred to about the coil producing the functioning or opening of the sectionalizer.

Finally, it is to be said that the conductor tube 1 or selectionalizer itself can be made for different service intensities.

I claim:

1. Automatic sectionalizer which being foreseen to automatically section a circuit, under preset conditions, insulating it and signaling the line defect, and having a conductor tube that has assembly and connecting means with regard to an insulating support provided with respective contacts, said conductor tube being initially connected to and between said contacts, comprising: an opening mechanism, means for activating the opening mechanism when the preset conditions are produced, said activating means having an electromagnet associated with two arms located axially in the inside of the conductor tube in such a way that the core or coil of the electromagnet in an inoperative position remains inserted between top ends of the two arms, the top ends of the arms being biased towards a closed position by means of a tension spring placed transversally between the two arms, the bottom ends of said arms being elbowed and retaining, in said inoperative position, a triggering rod that emerges outside of said tube, and a triggering pawl outside of said tube and connected to said rod, such that the excitation of the electromagnet and corresponding withdrawal of the coil or core from between the top ends of the arms will cause said top ends to move to said closed position, and cause the bottom ends of the arms to move apart and release the triggering rod and also cause the consequent release of the conductor tube with regard to the contacts which it was between.

* * * * *